US006106408A

United States Patent [19]

Roman

[11] Patent Number: 6,106,408

[45] Date of Patent: Aug. 22, 2000

[54] GOLF STANCE TRAINING DEVICE

[76] Inventor: Leonard W. Roman, 452 S. Grant St., Wilkes-Barre, Pa. 18702

[21] Appl. No.: 09/255,270

[22] Filed: Feb. 23, 1999

[51] Int. Cl.[7] ..... A63B 53/06; A63B 53/16; A63B 19/36

[52] U.S. Cl. ..... 473/266; 473/217; 473/218; 473/266; 473/270; 473/271; 473/272; 473/273

[58] Field of Search ..... 473/217, 218, 473/266, 270, 271, 272, 273

[56] References Cited

U.S. PATENT DOCUMENTS

| | | | |
|---|---|---|---|
| 1,517,555 | 12/1924 | Graham . | |
| 2,025,519 | 12/1935 | Lingg . | |
| 2,169,407 | 8/1939 | Crowley . | |
| 2,652,251 | 9/1953 | Molinar . | |
| 4,257,608 | 3/1981 | Funk . | |
| 4,538,815 | 9/1985 | Poirer | 273/187 R |
| 4,736,952 | 4/1988 | Taft et al. . | |
| 5,013,044 | 5/1991 | Hesselbart | 273/186 C |
| 5,083,789 | 1/1992 | Hickson . | |
| 5,108,106 | 4/1992 | Cook | 273/187 R |
| 5,246,234 | 9/1993 | Zanbekku . | |
| 5,362,060 | 11/1994 | Hinson . | |
| 5,415,407 | 5/1995 | Beatty . | |
| 5,435,727 | 7/1995 | Dobson . | |
| 5,464,220 | 11/1995 | Hansen et al. | 273/186.1 |
| 5,527,037 | 6/1996 | Matsumoto | 473/218 |
| 5,599,240 | 2/1997 | Feldmeier . | |
| 5,672,118 | 9/1997 | Robbie | 473/257 |
| 5,707,301 | 1/1998 | Tollin | 473/257 |
| 5,730,659 | 3/1998 | Morita | 473/218 |

*Primary Examiner*—Stephen F. Gerrity
*Assistant Examiner*—Paul D. Kim
*Attorney, Agent, or Firm*—David A. Tamburro

[57] ABSTRACT

A golf stance training device comprises an elongated base strip and foot guide means extending rearwardly from said base strip and adapted to guide the placement of the front foot of a golfer. A lateral strip has one end adjustably pivotally connected to the front end of the base strip and extends laterally forwardly therefrom. A forwardly outwardly inclined diagonal strip is connected the other end of said lateral strip, with the lateral strip being adjustably moveable along said diagonal strip. A ball positioning strip, when in use, is fixed to the front end of said diagonal strip at a predetermined angle and extends rearwardly to establish a ball placement position. The lateral strip is adjustable with respect to the base strip and the diagonal strip so as to adjust the device for use by golfers of different heights. The ball positioning strip is substantially parallel to the base strip for all adjusted positions.

6 Claims, 2 Drawing Sheets

GOLF STANCE TRAINING DEVICE

BACKGROUND OF THE INVENTION

This invention relates generally to training and practice devices for golfers, and more particularly to a novel golf stance training device which enables a golfer of any height or size to correctly align himself and a golf club with respect to a golf ball and thereby swing the club through an optimum swing pattern in striking the ball.

In the past, various stance devices have been proposed to aid golfers in properly addressing a golf ball, but they have not been readily adaptable for use by golfers of various heights and sizes. Thus, they have experienced limited success.

SUMMARY OF THE INVENTION

Accordingly, the primary object of this invention is to provide a novel golf stance training device which is readily adjustable for use by golfers of different heights and sizes to enable a golfer to correctly align himself and a golf club with a golf ball.

The invention accomplishes its objective by providing a stance training device comprising an elongated base strip extending in a direction toward a target and a lateral strip having one end adjustably pivotally attached to the front end of the base strip, the angle at which the lateral strip is set being indicated by an element fixed to the base strip. The other end of the lateral strip is pivotally slidably attached to a diagonal strip which, during use, is fixed to a golf ball positioning strip which extends parallel to the base strip in direct alignment with the target. A pair of longitudinally spaced foot guide pegs are pivotally attached to the base strip and, during use, extend laterally from the opposite side of the base strip to assist a golfer in properly positioning his feet and body with respect to a golf ball placed in line with the positioning strip.

To accommodate golfers of various heights, weights, and sizes, the lateral strip is angularly pivotable relative to the base strip, and slidably adjustable along the length of the diagonal strip. The rearmost foot guide peg is slidably adjustable long the base strip. Corresponding indicia on the base and diagonal strips and on the angle indicating element 10. pertaining to the height of a golfer enable the practice device to be quickly adjusted for use by a golfer of any size, the adjustments automatically positioning the golfer and the club head in the optimal swing plane relative to the ball.

Further, the novel practice device of the invention is preferably constructed of lightweight plastic of green color to blend with the green grass background and is foldable into a compact carrying form which requires less space than a typical golf club and easily fits into a golf bag.

Other objects and advantages will become apparent from reading the following detailed description of the invention in which reference is made to the accompanying drawings.

DETAILED DESCRIPTION OF THE INVENTION

Figure 1:
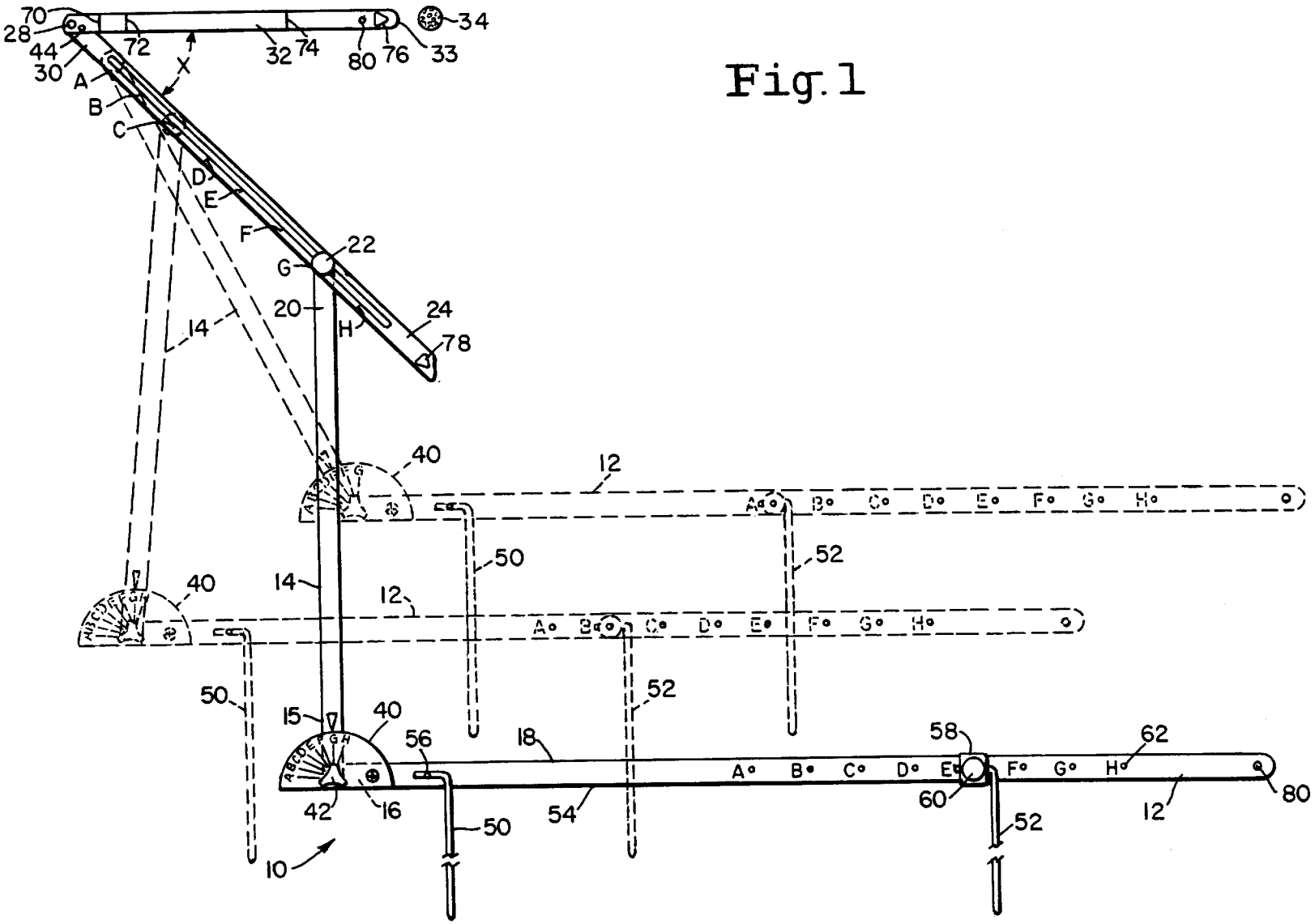
FIG. 1 is a top plan view of the practice device of the invention as it would appear in place on the ground ready for use by a golfer.

Referring to the drawings, the novel golf stance training device 10 of the invention, shown in FIG. 1 at a scale of about ⅙ actual size, includes a thin flat base strip 12 (about 36" long) and a lateral support strip 14 (about 20" long) pivotally adjustably connected at one end 15 to the front end 16 of strip 12 and extending laterally from the forward side 18 thereof. The other end 20 of strip 14 is connected via knob 22 to a forwardly outwardly inclined diagonal strip 24 (about 20" long). Knob 22 has a threaded shaft which passes through a slot 26 in diagonal strip 24 and threads into upper end 20 of strip 14. Pivotally connected at 44 to the front end 30 of strip 24 is a golf ball positioning strip 32 (about 12 ½" long) which, in use, extends rearwardly from end 30 in direct alignment with the target toward which golf ball 34 is to be hit and parallel with strip 12. In use, ball 34 is normally positioned about 1" from the end 33 of strip 32.

Strip 14 is adjustable angularly with respect to base strip 12 and an angle indicator 40 which is fixed to strip 12. When the angle is set, knob 42 is tightened to lock strips 12 and 14 in the set position.

In the operable position of FIG. 1, strips 32 and 24 are locked together at an angle X of 45° by a removable pin or spring loaded detent 44.

Figure 2:
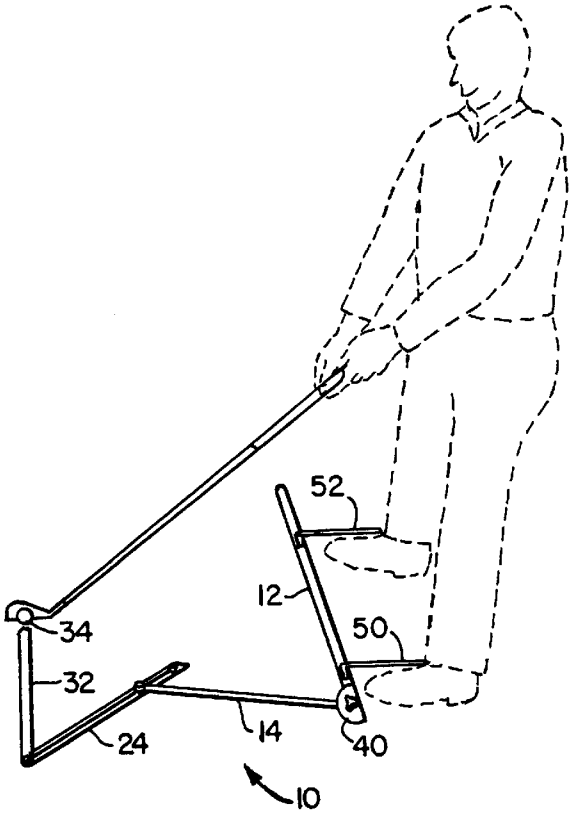
FIG. 2 is a general perspective view illustrating the device being used by a golfer.

A pair of foot guide pegs 50 and 52 are adapted to extend laterally from the rear side 54 of strip 12. Front peg 50 is pivotally connected at 56 to strip 12 while rear peg 52 is pivotally connected to a slide 58 which is slidable along strip 12 to a set position and then locked in place by turning knob 60 to seat in one of the openings 62. In use as in FIG. 2, front peg 50 correctly aligns a golfer's front foot with ball 34.

Each of strips 12 and 24 and angle indicator 40 have corresponding indicia A, B, C, D, E, F, G, H, printed thereon representing adjustment positions for golfers of different height. For example, for a golfer about 3' tall, slide 58 is positioned at indicia A or B on strip 12, lower end 15 is at markers A or B on indicator 40, and end 20 and knob 22 of strip 14 is at markers A or B on strip 24. Similarly, for a 4' golfer the components are positioned at markers C or D, for a 5' golfer at markers E or F, and for a 6' golfer at markers G or H. In every position, strips 12 and 32 are substantially parallel.

Strip 32 may be appropriately bent at lines 70, 72 and 74 so that end 33 may lie flat on the ground ahead of ball 34. A horizontal alignment arrow 76 on strip 32 and a vertical alignment arrow 78 on strip 24 assist the golfer in seeing the ball prior to contact.

The pivoting angular adjustment of end 15 of strip 14 along indicator 40 and the sliding adjustments of end 20 along the length of diagonal strip 24 provide a very sensitive, accurate adjustment of the various parts to accurately set the device for use by golfers of different heights.

In every adjusted height position, the forward location of ball 34 with respect to arrows 76 and 78 and foot guide peg 50 is substantially the same. Thus, regardless of the height of the golfer, when properly adjusted, device 10 automatically correctly aligns the golfer with ball 34 so that the golfer may maintain an optimal swing pattern for the club through the ball.

A number of spikes 80 may be provided on the strips to hold device 10 in place when in use.

Figure 3:
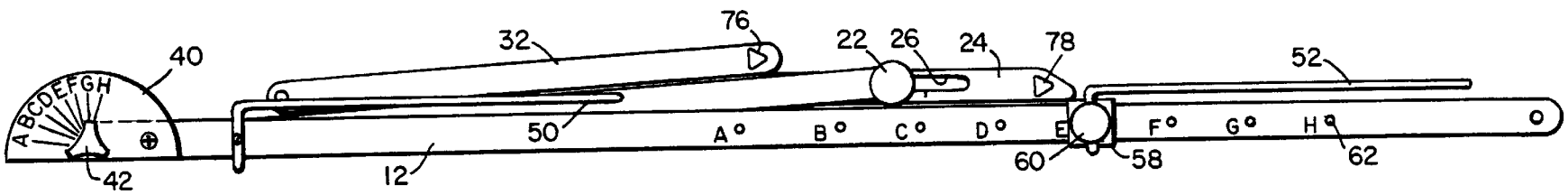
FIG. 3 is a top plan view of the device folded into its storage position.

Device 10 may be conveniently constructed of lightweight plastic and is readily foldable to the compact form of FIG. 3 in which it is easily stored in a golf bag. The device is preferably colored green to blend in with the grass on which it lies so that the golfer is not distracted by the device. Further, pegs 50 and 52 may be contoured to conform to the shape of a golfer's shoes, and the device may be constructed for use by either left-handed or right-handed golfers.

The foregoing relates to preferred exemplary embodiments of the invention, it being understood that other variants and embodiments thereof are possible within the spirit and scope of the invention, the latter being defined by the appended claims.

What is claimed is:

1. A golf stance training device comprising an elongated base strip having a front end directed toward a target toward which a golf ball is to be hit, foot guide means extending laterally rearwardly from said base strip and adapted to guide the placement of the front foot of a golfer, a lateral strip having one end adjustably pivotally connected to the front end of said base strip and extending laterally forwardly therefrom, a forwardly outwardly inclined diagonal strip, means connecting the other end of said lateral strip to said diagonal strip for adjusting movement along said diagonal strip, a ball positioning strip attached to the front end of said diagonal strip at a predetermined angle and extending longitudinally rearwardly to establish a ball placement position, said lateral strip being adjustable to a plurality of operative set positions with respect to said base strip and said diagonal strip so as to adjust the device for use by golfers of different heights, and said ball positioning strip being substantially parallel to said base strip for all adjusted positions.

2. The golf stance training device of claim 1, wherein said ball positioning strip locates a golf ball in substantially the same forward position with respect to said front foot guide means for all adjusted positions.

3. The golf stance training device of claim 2, comprising rear foot guide means extending rearwardly from said base strip and adapted to guide placement of the rear foot of a golfer, said rear foot guide means being adjustable along said base strip to accommodate golfers of different heights.

4. The golf stance training device of claim 3, comprising indicator means for indicating the angle of adjustment of said lateral strip with respect to said base strip, and corresponding indicia on said base strip, said indicator means, and said diagonal strip for establishing set positions of said rear foot guide means on said base strip and of said lateral strip with respect to said base strip and said diagonal strip, said set positions corresponding to golfers of different heights.

5. The golf stance training device of claim 4, wherein said strips fold into compact storage positions.

6. The golf stance training device of claim 1, comprising indicator means for indicating the angle of adjustment of said lateral strip with respect to said base strip, and corresponding indicia on said indicator means and said diagonal strip for establishing set positions of said lateral strip with respect to said base strip and said diagonal strip, said set positions corresponding to golfers of different heights.

* * * * *